US005846104A

United States Patent [19]

Corcoran

[11] Patent Number: 5,846,104

[45] Date of Patent: Dec. 8, 1998

[54] WATER DIVERTING APPARATUS

[76] Inventor: Daniel P. Corcoran, 1252 Nebobish St., Essexville, Mich. 48732

[21] Appl. No.: 814,529

[22] Filed: Mar. 10, 1997

[51] Int. Cl.[6] ..... B63H 11/00

[52] U.S. Cl. ..... 440/39; 440/40; 441/71

[58] Field of Search ..... 440/38, 39, 41–42; 441/71; 116/209

[56] References Cited

U.S. PATENT DOCUMENTS 3,993,015 11/1976 Klepacz et al. ..... 440/42

4,699,596 10/1987 Klinker et al. ..... 441/71

4,832,632 5/1989 Rogozienski ..... 440/39

5,150,663 9/1992 Kobayashi ..... 441/71

*Primary Examiner*—Ed L. Swinehart

*Attorney, Agent, or Firm*—Robert L. McKellar

[57] ABSTRACT

A water diverting apparatus for adaptation to a recreational motor ski vehicle. The apparatus provides a water rooster tail during the operation of the motor ski vehicle without degrading the nominal speed of the motor ski vehicle or preventing agile maneuvering of the motor ski vehicle.

6 Claims, 3 Drawing Sheets

WATER DIVERTING APPARATUS

The invention disclosed and claimed herein deals with a device which attaches to the exhaust of a motor ski vehicle and diverts water such that a water spray is created in the form of the well-known "rooster tail".

This device allows the diversion of a certain amount of the water passing through the exhaust of the motor ski vehicle to create a water spout behind the vehicle while at the same time allowing the motor ski vehicle to maintain the normal speeds and maneuvering that it was designed to do.

BACKGROUND OF THE INVENTION

Applicant is not aware of any patents or other publications which describe such devices as are claimed herein. Motor ski vehicles are very popular and are used by the millions as recreational vehicles on lakes and streams.

Part of the recreation is the ability to throw a long spout of water behind the vehicle as it is maneuvering across a body of water. This water spout, commonly known as a "rooster tail" has not been produced by any production models of motor ski vehicles. Some vehicles are equipped with a built-in water diverter which produces a ¾ inch water spout, but is not commonly thought of as a "rooster tail". This equipment is utilized for safety reasons, in that, the water spout produced by this equipment is a solid water flow having a diameter of about ¾ inches and generally rising about ten feet above the vehicle and trailing the vehicle by about eight feet, so that other watercraft can see the vehicle producing such spouts.

The device of the instant invention allows for the production of a significant rooster tail, on the order of up to about thirty feet high and about thirty feet long, yet this device does not detract from the normal speed of the vehicle, nor does it cut down on the ability of the vehicle to turn or otherwise maneuver.

THE INVENTION

The invention herein deals with a water diverting device which is detachedly attachable to the exhaust of a motor ski vehicle such that it provides a water spray or "rooster tail" from such device when the motor ski vehicle is used on the water.

Thus, the invention is a water diverting apparatus the apparatus comprising a bell housing having an outside surface, a flat front end, an angled back end, and a top surface. The bell housing has a hole through its top surface near the angled back end. The hole is surmounted by a hub, the hub having an interior surface and the hub containing an attaching means on the its inside surface.

There is a diverter assembly, which can be comprised of a unitary construction comprising three essential segments: (i) a hollow center segment which is adapted to be attached to the hub; (ii) a lower segment which is a first hollow tube having a fluid communication with and projecting downwardly from the center segment, the first hollow tube having an outside surface. The first hollow tube is essentially open through the outside surface facing the front of the bell housing. There is a third segment, (iii) which is an upper segment. The upper segment is comprised of a second hollow tube having an upper end and a lower end, the second hollow tube being surmounted on the center segment by the lower end thereof. It has a fluid communication with the hollow center segment. The upper end of the second hollow tube has an opening having essentially an elongated configuration such that a portion of any water moving through the front of the bell housing is moved into the open outside surface of the lower segment, enters and passes through the interior of the center segment, and exits the diverter assembly through the elongated opening.

In addition, the inventors contemplate within the scope of this invention the modification of the device as set forth in FIGS. 5, 6, and 7 comprising a semi-circular housing rather than a full bell housing.

DETAILED DESCRIPTION OF THE INVENTION

Figure 1:
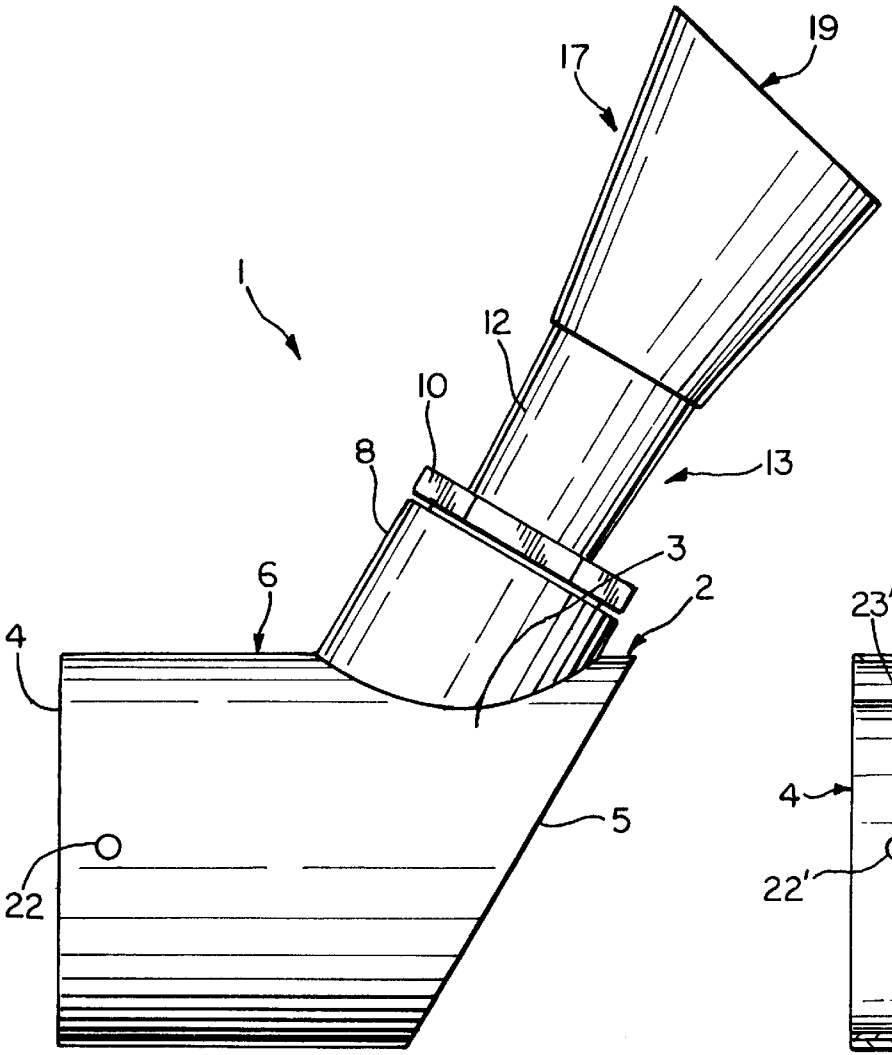
FIG. 1 is a full side view of a device of this invention.

With reference to FIG. 1, there is shown a water diverting apparatus 1 of this invention wherein there is shown a bell housing 2 having an outside surface 3, a flat front end 4, an angled back end 5, and a top surface 6. The bell housing 2 has a large hole 7 through its top surface 6 (see FIG. 2), near the angled back end 5. The large hole 7 is surmounted by a large hub 8 and the hub 8 has an interior surface 9 (see FIG. 2), and the hub 8 contains an attaching means 10 on the interior surface 9 which is used to attached a hollow center segment 12 of the diverter assembly 13, which is described in detail infra.

Figure 2:
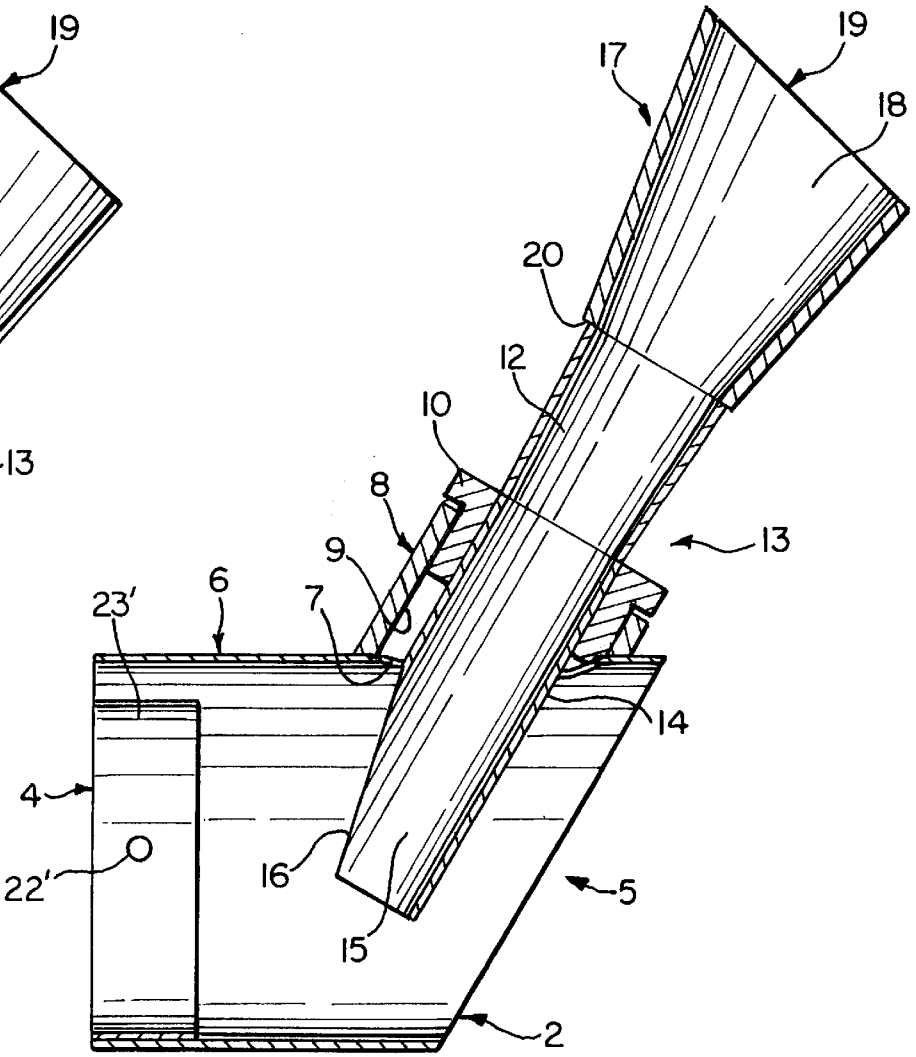
FIG. 2 is a cross sectional view of FIG. 1 through the line A—A.

The diverter assembly 13 is generally shown in FIG. 2 which is comprised generally of a unitary construction, but it is contemplated within the scope of this invention that the diverter assembly 13 can be comprised of one or more segments by the use of Luer lock® connections, or threaded parts, or the like. Preferred is a unitary construction. The diverter assembly 13 can be removed and replaced with a solid plug so as to have a true water flow through the exhaust when the user wishes to prevent a rooster tail.

The diverter assembly 13 has three general elements or segments.

The first segment is a hollow center segment 12 which is adapted to be attached to the hub 8 by the attaching means 10 as described above.

The second, or lower segment 14 comprises a first hollow tube 15 having a fluid communication with the hollow center segment 12. This segment 15 projects downwardly from the center segment 12 and opens into the bell housing 2. The hollow tube 15 has an opening 16 (FIG. 3), the opening 16 facing the flat front end 4 of the bell housing 2.

Figure 4:
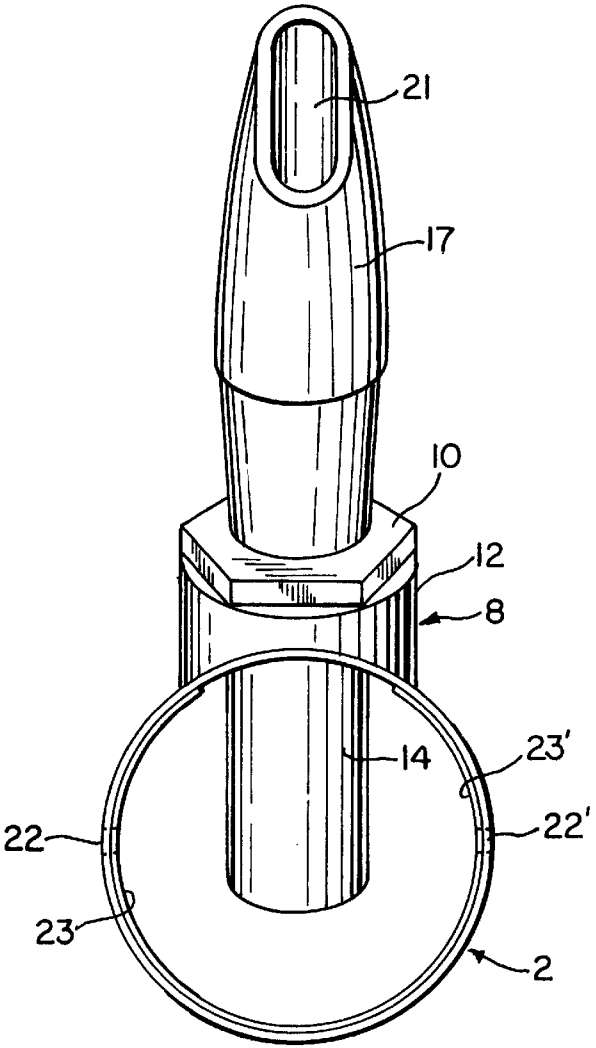
FIG. 4 is a full back view of the device of FIG. 1.

The third, or upper segment 17 comprises a second hollow tube 18 (FIG. 2) having an upper end 19 and a lower end 20. The second hollow tube 18 is surmounted on the center segment 12 at the lower end 20 and aligned therewith such that their respective hollow centers are essentially commensurate with each other. The second hollow tube 18 has a fluid communication with the hollow center segment 12. The upper end 19 of the second hollow tube 18 has an opening 21 having essentially an elongated configuration (see FIG. 4) such that a portion of any water moving through the flat front end 4 of the bell housing 2 can move into the open lower segment 14, enter and pass through the interior of the center segment 12, and exit the diverter assembly 13 through the elongated opening 21. When the water exits, it is under extreme pressure which causes the water to be ejected upwardly and creating the rooster tail effect. The major portion of the water, and any exhaust from the engine of the motor ski vehicle moves past the lower segment 14 and out through the angled back end 5 of the bell housing 2 to create the propulsion for the motor ski vehicle.

Figure 7:
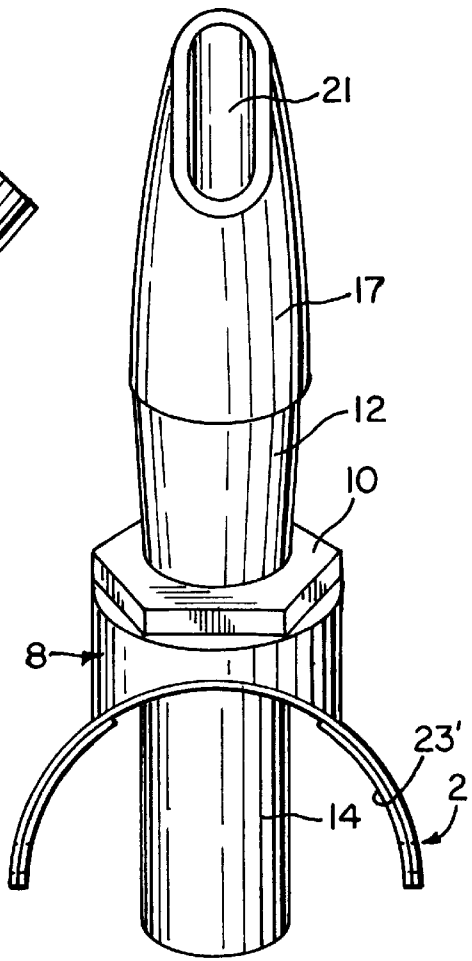
FIG. 7 is a full back view of the device of FIG. 5.
Figure 5:
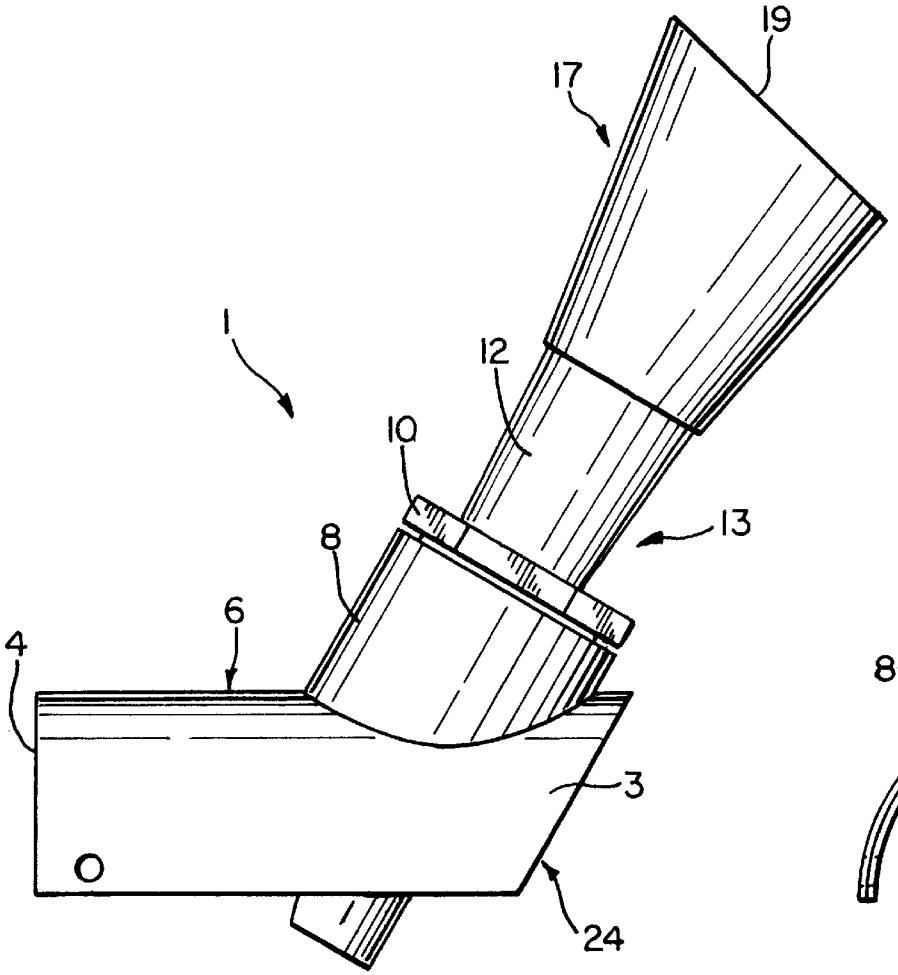
FIG. 5 is a full side view of a device of this invention that has been modified.
Figure 6:
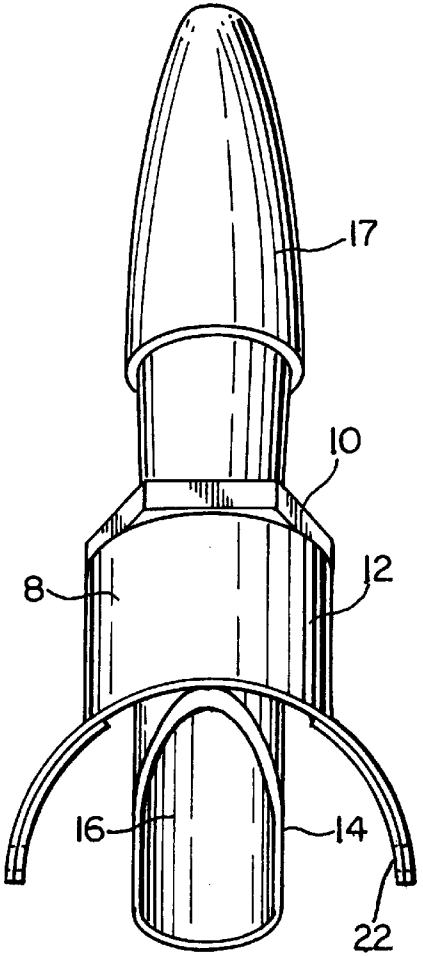
FIG. 6 is a full front view of the device of FIG. 5.

Turning now to the device as illustrated in FIG. 5, it can be observed that the device is essentially the same device as is found in FIG. 1, except that the bottom half of the bell housing 2 is removed to leave a semicircular housing 24. As is shown in FIGS. 6 and 7, the semi-circular housing 24 leaves the bottom of the bell housing 2 open.

By diverting a small portion of the exiting water by this means, the motor ski vehicle loses only a very small amount of the speed it was designed to accommodate. Furthermore, the maneuverability of the motor ski vehicle is not affected by the use of this device.

Figure 3:
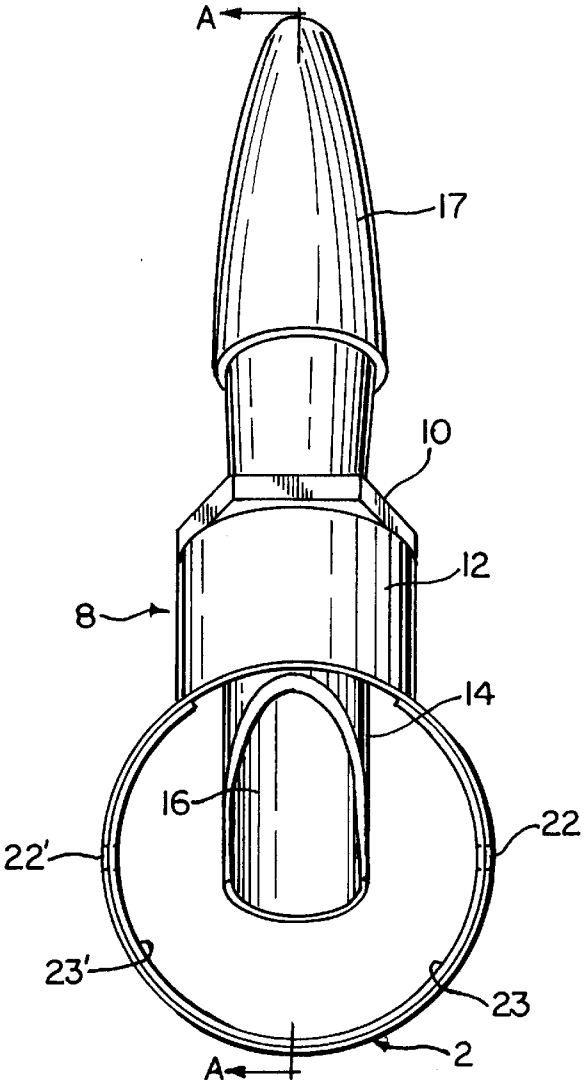
FIG. 3 is a full front view of the device of FIG. 1.

The devices of this invention can be attached to the motor ski vehicle at the manufacturer's site such as by welding in the case of metal, gluing such as in the case of plastic, threading or bolting, such as in the case of metal or plastic, or they can be configured such that they are portable and attachable to any motor ski vehicle. Thus, this invention also contemplates in addition, a means of affixing a device of this invention to a motor ski vehicle. With reference to FIG. 1, there is therefore shown holes 22 and 22', 22 shown in FIG. 1 and holes 22 and 22' shown in phantom in FIG. 3. Furthermore, contemplated within the scope of this invention is a means of adapting the bell housing 2 to the exhaust of a motor ski vehicle, which is shown in FIG. 3, as adapters 23 and 23' which are shown as a portion of a ring configuration, although the inventor herein contemplates that the adapters 23 and 23' can be one continuous ring around the inside surface of the bell housing 2.

As implied above, the devices of this invention can be fabricated from plastic or metal, especially reinforced plastics or crosslinked plastics, such as fiber reinforced nylons or urethanes, or crosslinked polyethylenes.

I claim:

1. A water diverting apparatus, said apparatus comprising:

a bell housing having an outside surface, a flat front end, an angled back end, and a top surface, said bell housing having a hole through its top surface near the angled back end, said hole being surmounted by a hub, said hub having an interior surface and said hub containing an attaching means on the inside surface;

a diverter assembly, said diverter assembly comprised of a unitary construction comprising three essential segments:

(i) a hollow center segment which is adapted to be attached to the hub;

(ii) a lower segment which is a first hollow tube having a fluid communication with and projecting downwardly from the center segment, said first hollow tube having an outside surface and being essentially open through the outside surface facing the front of the bell housing;

(iii) an upper segment, said upper segment comprising a second hollow tube having an upper end and a lower end, said second hollow tube being surmounted on the center segment by the lower end thereof and having a fluid communication with the hollow center segment, the upper end of said second hollow tube having an opening having essentially an elongated configuration such that a portion of any water moving through the front of the bell housing can move into the open outside surface of the lower segment, enter and pass through the interior of the center segment, and exit the diverter assembly through the elongated opening.

2. A water diverting apparatus as claimed in claim 1 wherein the water diverter apparatus additionally has a means near the front of the bell housing for attaching the bell housing of the water diverter to the exhaust of a motor ski vehicle.

3. A water diverting apparatus as claimed in 2 wherein there is additionally used an adapter to adapt the bell housing to the exhaust of a motor ski vehicle.

4. A water diverting apparatus, said apparatus comprising:

a semi-circular housing having an outside surface, a flat front end, an angled back end, and a top surface, said semi-circular housing having a hole through its top surface near the angled back end, said hole being surmounted by a hub, said hub having an interior surface and said hub containing an attaching means on the inside surface;

a diverter assembly, said diverter assembly comprised of a unitary construction comprising three essential segments:

(i) a hollow center segment which is adapted to be attached to the hub;

(ii) a lower segment which is a first hollow tube having a fluid communication with and projecting downwardly from the center segment, said first hollow tube having an outside surface and being essentially open through the outside surface facing the front of the semi-circular housing;

(iii) an upper segment, said upper segment comprising a second hollow tube having an upper end and a lower end, said second hollow tube being surmounted on the center segment by the lower end thereof and having a fluid communication with the hollow center segment, the upper end of said second hollow tube having an opening having essentially an elongated configuration such that a portion of any water moving through the front of the semi-circular housing can move into the open outside surface of the lower segment, enter and pass through the interior of the center segment, and exit the diverter assembly through the elongated opening.

5. A water diverting apparatus as claimed in claim 4 wherein the water diverter apparatus additionally has a means near the front of the semi-circular housing for attaching the semi-circular housing of the water diverter to the exhaust of a motor ski vehicle.

6. A water diverting apparatus as claimed in 5 wherein there is additionally used an adapter to adapt the semi-circular housing to the exhaust of a motor ski vehicle.

* * * * *